US008746402B2

(12) United States Patent
Nichols, Jr.

(10) Patent No.: US 8,746,402 B2
(45) Date of Patent: Jun. 10, 2014

(54) DEVICES, SYSTEMS AND METHODS RELATING TO FALL PROTECTION ANCHORAGE FOR OVER HEAD AND ROOFING INSTALLATION FEATURING EVACUATION FROM SERVICE

(76) Inventor: Steven Christopher Nichols, Jr., Duvall, WA (US)

( * ) Notice: Subject to any disclaimer, the term of this patent is extended or adjusted under 35 U.S.C. 154(b) by 35 days.

(21) Appl. No.: 13/205,067

(22) Filed: Aug. 8, 2011

(65) Prior Publication Data

US 2012/0031700 A1 Feb. 9, 2012

Related U.S. Application Data

(60) Provisional application No. 61/371,504, filed on Aug. 6, 2010.

(51) Int. Cl.
*A62B 35/00* (2006.01)

(52) U.S. Cl.
CPC ..... *A62B 35/0068* (2013.01)
USPC ..... 182/45; 248/237; 52/698; 182/3

(58) Field of Classification Search
CPC ..... A62B 35/0068; A62B 35/0043; E04G 21/3276; E04G 21/329; E04G 21/3285; E04G 21/328
USPC ..... 182/3, 45; 248/237; 52/698, 712–715, 52/655.1
See application file for complete search history.

(56) References Cited

U.S. PATENT DOCUMENTS 2,703,688 A * 3/1955 Shuter ..... 248/72
2,976,003 A * 3/1961 Foster ..... 248/243
3,359,701 A * 12/1967 Schneller ..... 52/712
3,481,635 A * 12/1969 Tracy ..... 403/3
3,883,926 A * 5/1975 Reynolds ..... 248/74.1
3,907,445 A * 9/1975 Wendt ..... 403/191
4,851,977 A * 7/1989 Gary ..... 362/249.01
5,143,171 A * 9/1992 Glynn et al. ..... 182/3
5,248,021 A * 9/1993 Nichols ..... 182/3
5,319,896 A * 6/1994 Winger ..... 52/23
5,343,975 A * 9/1994 Riches et al. ..... 182/3

(Continued)

OTHER PUBLICATIONS

Definition of 'unitary' can be found in the Action Random House Kernerman Webster's College Dictionary, © 2010 K Dictionaries Ltd. Copyright 2005, 1997, 1991 by Random House, Inc. All rights reserved.*

(Continued)

*Primary Examiner* — Katherine Mitchell
*Assistant Examiner* — Daniel Cahn
(74) *Attorney, Agent, or Firm* — Graybeal Jackson LLP

(57) ABSTRACT

A fall protection anchor and related systems and methods. The anchor comprises a first elongate leg and a second elongate leg connected to each other at a base plate. The first elongate leg comprises a first base end and a first apex end and further comprises a first capture portion near the first base end and a first intra-connection portion near the first apex end. At least the second elongate leg comprises a second base end and a second apex end and further comprises a second capture portion near the second base end and a second intra-connection portion near the second apex end as well as a holding portion located beyond the capture portion: the holding portion comprises a holding element such as holding hole configured to securely hold a fall restraint device connected to a worker.

18 Claims, 4 Drawing Sheets

(56) References Cited

U.S. PATENT DOCUMENTS

| | | | | |
|---|---|---|---|---|
| 5,346,036 | A * | 9/1994 | Arisman et al. | 182/3 |
| 5,361,726 | A * | 11/1994 | Harris et al. | 119/797 |
| 5,370,202 | A * | 12/1994 | Nichols | 182/3 |
| 5,406,809 | A * | 4/1995 | Igelmund | 70/2 |
| 5,553,685 | A * | 9/1996 | Cook | 182/45 |
| 5,595,260 | A * | 1/1997 | Jalla | 182/3 |
| 5,727,646 | A * | 3/1998 | Gray | 182/45 |
| 5,730,407 | A * | 3/1998 | Ostrobrod | 248/237 |
| 5,758,743 | A * | 6/1998 | Coyle et al. | 182/45 |
| 5,829,203 | A * | 11/1998 | Ealer, Sr. | 52/37 |
| 5,845,452 | A * | 12/1998 | Pantano | 52/698 |
| 5,896,719 | A * | 4/1999 | Thornton | 52/698 |
| 5,937,073 | A * | 8/1999 | Van Gieson | 381/391 |
| 6,209,277 | B1 * | 4/2001 | DiGate | 52/514 |
| 6,345,689 | B1 * | 2/2002 | McNamee | 182/45 |
| 6,595,664 | B2 * | 7/2003 | Bucher et al. | 362/404 |
| 6,619,919 | B2 * | 9/2003 | Kerr, Jr. | 416/5 |
| 6,786,020 | B2 * | 9/2004 | Poldmaa | 52/704 |
| 6,991,352 | B2 * | 1/2006 | Garber et al. | 362/396 |
| 8,028,477 | B2 * | 10/2011 | Crookston | 52/127.5 |
| 8,037,643 | B1 * | 10/2011 | Anderson | 52/57 |
| 2001/0025464 | A1 * | 10/2001 | Poldmaa | 52/633 |
| 2003/0159882 | A1 * | 8/2003 | Franckewich, Jr. | 182/82 |
| 2003/0192740 | A1 * | 10/2003 | Peterson et al. | 182/36 |
| 2004/0069565 | A1 * | 4/2004 | Luke et al. | 182/3 |
| 2005/0189171 | A1 * | 9/2005 | Bos | 182/36 |
| 2006/0059858 | A1 * | 3/2006 | Layman | 52/749.12 |
| 2006/0180390 | A1 * | 8/2006 | Thaler | 182/45 |
| 2006/0196140 | A1 * | 9/2006 | Crookston | 52/636 |
| 2008/0156587 | A1 * | 7/2008 | Lara | 182/192 |
| 2010/0200330 | A1 * | 8/2010 | Crookston | 182/3 |
| 2012/0079786 | A1 * | 4/2012 | O'Donnell | 52/698 |
| 2012/0222370 | A1 * | 9/2012 | Crookston | 52/173.1 |
| 2012/0312633 | A1 * | 12/2012 | Massey | 182/3 |
| 2013/0206940 | A1 * | 8/2013 | Hopkins et al. | 248/237 |

OTHER PUBLICATIONS

Performance Safety Gear (catalog), showing "Temper Reusable Anchor; Stainless Steel Reusable Anchor; Truss-T Anchor; SP-Anchor; Halo Anchor; Truss Boss Anchor; T-T Boss Anchor; Global Anchor; Skyhook, Snappy Disposable Anchor and Ridge-It Anchors" WA-Anchor Guardian Fall Protection, (4 pages) 2008-2009, Kent WA, United States.

"Compliance Without Compromise (brochure)" Residential Construction, Capital Safety-USA (DBI Sala), Form:9700477 rev. F, (4 pages), 2011, Red Wing, MN, United States.

"Roof Anchors" Fall Protection, Precision Engineered (Catalog) Fall Tech, vol. 64, p. 41, 2011/2012, Compton, CA, United States.

"Roof Anchors" http://multimedia.3m.com (online catalog), 3M Corporation, p. 23, 2012, St. Paul, MN, United States.

"Yoke Safety Components for Fall Protection" (catalog) Yoke Industrial Corp, p. 62, 2009, Taichung, Taiwan.

"Rope Grabs/Anchorage Connectors" Industrial catalog, Usang Industrial Co. Ltd. 2010, Taipei City, Taiwan.

* cited by examiner

DEVICES, SYSTEMS AND METHODS RELATING TO FALL PROTECTION ANCHORAGE FOR OVER HEAD AND ROOFING INSTALLATION FEATURING EVACUATION FROM SERVICE

PRIORITY CLAIM

The present application claims the benefit of U.S. Provisional Patent Application No. 61/371,504, filed Aug. 6, 2010, which application is incorporated herein by reference in its entirety.

BACKGROUND

Builders have reservations about leaving permanent anchorage devices on residential and multi-family structures due to legal concerns, yet are required to ensure that safety is implemented on their job sites. A number of removable anchorage devices are available that attach to sheathing or top chords using many fasteners which are labor intensive to install and remove.

Thus, there has gone unmet a need for improved systems and methods of anchor attachment and removal. The present systems and methods, etc., provide these and/or other advantages.

SUMMARY

Disclosed herein are devices, systems and methods relating to fall protection anchorage for overhead and roofing installation. The devices, etc., comprise configurations, structures and methods for improved evacuation from service (removal from the location of use) once the need for the anchor no longer exists.

The anchors herein can be used for any suitable anchoring purpose, for example construction such as new and existing wood and steel framed structures requiring fall protection. The anchors are typically used on and attached to roofs but can be attached to any suitable structure strong enough to safely withstand a fall by a worker attached to the anchor.

The anchors can be produced in any desired configuration provided they comprise the elements discussed herein. Exemplary models include:

1) A temporary fall protection anchorage device configured to attach to softer structures such as wood framed structures, for example at top chords of trusses or rafters. This temporary fall protection anchorage device is designed for easy removal and can be made from any suitable material such as zinc coated steel or stainless steel (SST).
2) A permanent fall protection anchorage device made from a suitable long-lasting material such as SST. This device is configured so that it can be installed in an inverted position, if desired, for example to be used as an anchorage device in attics or confined spaces, as an overhead anchorage device, or flashed into the roofing membrane.
3) A permanent fall protection anchorage device configured to utilize a flashing system. This device is typically integral to the roofing membrane and features a design that allows the anchor to be evacuated if desired.

The removable anchors herein comprise a triangular or U shape, as shown in the exemplary figures included herewith. Exemplary dimensions of the device include about 8.5" length and 2" width. The devices comprise two elongate anchor legs joined to each other, for example at a base plate.

Typically, one leg is longer than the other. At least one of the legs is bent at an angle relative to the other with the apex point (the end of the leg located away from, or distal to, the base) of the shorter leg intersecting the longer leg, for example about 2-½" from the top of the long leg. The two legs are joined together at first and second intra-connection portions using any suitable binding device, for example a 7/16" grade 8 bolt and lock nut.

The two legs comprise first and second capture portions configured to create a capture area and thus to capture a retention element such as a top chord to hold the anchor to a structure. The finished installation of the anchor captures (i.e., fully or substantially envelopes or wraps around) the top chord, preferably without use of any bolt, screws, nails or other fastening elements penetrating through the anchor and the chord (retention element). Thus, this device is much stronger and more dependable than traditional surface mounted devices and can withstand over 5000 lbs. of force or more when subjected to static pull testing yet does not compromise the integrity or strength of the chord, and can be easily removed from or moved along the chord.

The long leg of the anchor device comprises a holding portion, typically distal to the capture area, which holding portion holds onto the fall restraint device attached to the worker. The holding portion can comprise an opening or other capture device to receive or grab onto safety equipment connectors for fall restraint devices, such as cable loops, snap-hooks, carabiners or rebar hooks. If the capture device is an opening, the opening can be about 1-⅛" in diameter.

The one longer-leg configuration of the anchor devices herein create desirable installation features. For example, the two legs generate a spring action between them, for example having an apex width (e.g., 1.0") that is less than the width of the wood top chord member or other anchor-holding structure (e.g., 1.5") to produce a compression of the top chord member, which compression holds the anchor in desired position on the top chord without the need of fasteners to facilitate installation. In one embodiment, the anchor is installed from the underside of a top chord, and the shorter leg top edge of the anchor is aligned with the outside face of the top chord. The longer leg then provides a fulcrum that allows the anchor to be slid onto the top chord with very little effort. The compression of the two legs then holds the anchor in place.

If desired, both legs of the anchor can extend well beyond the capture area of the anchor, and can be substantially co-extensive. In such a case, both anchors can have a holding portion such as a hole that traverses both legs in corresponding locations to effectively provide a single hole.

The two sides of the anchor legs are joined to each other with an attachment bolt or other suitable device(s). This can result in an installation time of less than one (1) minute, with no drilling or other fasteners required to hold the anchor in place.

In certain embodiments, the anchors can be attached to a sheath in addition to the chord, and sheathing penetration for the stem (distal portions of the legs) of the anchor can be planned in advance. For example, suitable approaches can be a square opening (e.g., 2.5"×2.5") in the sheath or saw kerfs (e.g., ⅛"×2.5") for the anchor legs at the sheathing edges.

The easy compression design of the anchor (e.g., compressing by tightening down a single bolt) allows the anchor to be easily moved on its top chord or other underlying structure by loosening the attachment bolt and sliding the anchor along the chord, for example to align with sheathing joints when the anchor penetration is not planned in advance, or for adjustment after installation. This easy adjustment is not permitted by traditional anchors held in place by nails or screws or other mechanical fastening to the top chord.

The current anchor devices comprise an easy evacuation feature: simply undo the tightening screw and remove it from the top chord. Prior temporary anchorage devices attached to the structure sheathing do not allow the roofing membrane to be installed without removal, and may require cutting off the PPE (personal protective equipment) connector point of the anchor or bending over the attachment portion to evacuate. Moreover, traditional surface mounted anchorage devices require many fasteners and do not provide the peace of mind and security of a device that encapsulates the top chord.

The anchors herein can be installed through the roofing membrane leaving a small portion of the roofing unfinished and open to allow the anchor stem to be accessed. Once the roofing is completed, the anchor can be evacuated by removing the attachment bolt and hammering the top of the anchor stem down until it is out of the way of other construction, for example until it is flush with the roofing membrane. Evacuated or removed from service includes either or both physically removing the anchor device from the area or rendering the device redundant or inoperable, for example by the hammering down discussed herein. Hammering down a device can be advantageous as it is very quick and therefore cost effective while eliminating the anchor from future interference with the roof or other nearby structures. The roofing portion that was left unfinished is then completed.

The removable anchors herein may desirably remain accessible for the entire construction period to provide protection for other trades (workers). Thus, the final evacuation may not occur until the structure is completed. Note: the triangle design and/or sloped edge of the leg design in certain embodiments facilitate removal by eliminating stem/leg bends that may interfere with position movement, as well as by the absence of mechanical fastening of the anchor to the top chord.

The removable anchors herein can provide improved security features. The evacuation/removal of prior anchors can result in the prior anchors falling from the cord to the interior ceiling and damaging a finished structure. Therefore, in some embodiments the anchors herein further comprise enhanced safety via at least one of: 1) if the anchor herein is hammered down, the triangle design produces its maximum compression once it is driven below the finished roofing membrane and will hold a static position onto the top chord (or other support structure), and/or 2) the anchors herein can be fitted with a failsafe tether that has one end attached to the anchor, for example through a drilled hole in one anchor leg, and a fastener tab on the end of the tether that is secured to the top chord, for example with a nail or screw. Typically, the tether is engineered to support 25 times the weight of the anchor device, which anchor can be less than one (1) pound.

The removable anchors herein can provide improved shock absorbing features. The anchor stem that securely holds the fall restraint device connected to a worker can be subjected to a significant force when a fall occurs. To account for such a load, whether up or down slope on the top chord, the anchor stem has significant deflection resistance, for example 160-250 lbs. Thus, in the event of a fall, the stem of the anchor will absorb some of the force of the fall.

The removable anchors herein can provide a tell-tale feature, which can be correlated to the deflection of the anchor stem in the event of a fall-restraint-level force load: the anchor stem deflection is used to as a warning device to users who are required to inspect before each use. If the stem is bent, the worker is alerted that the anchor has been subjected to a fall-restraint-level force load and must not be used until it is replaced.

The removable anchors herein can provide improved resistance to position movement: anchors that encapsulate top chords (or other attachment structure) are prevented from movement by the encapsulating and compressing the chord. The anchors can be further secured in place using suitable fasteners such as nails or screws, or by drilling through the top chord and securing with a bolt, if desired.

The removable anchors herein are configured to fully or substantially envelop (wrap around) the support structure such as a top chord of a roof. This can be accomplished by a triangular or rectangular design as shown in the attached figures, although other geometric shapes can be used if desired. In certain embodiments, the anchors can rotate on the top chord and include a base plate that creates a gripping action when the anchor is subjected to an upslope or downslope force load. Such "free-swinging" use, typically on an overhead support structure, will not produce the unmoving gripping effect that occurs when the anchor stem is installed onto the top chord of a house (or other usage site) in its compressed position as described for other embodiments herein.

When such force load is applied, the base plate edge bites into the bottom of the chord (if the anchor is attached with its open end facing upward) while the apex point of the two legs joined together with the attachment bolt bites into the top edge of the chord. This action provides resistance to anchor movement along the top chord during a fall.

The anchors herein can be used both in open spaces such as the roof of a house as well as enclosed spaces such as inside an attic or crawl space where fall protection is required for workers installing HVAC, insulation, wiring, etc. in attic spaces that have a dangerous elevation above a floor or lower level (e.g., more than six (6) feet above the lower level or floor). Note: Finished ceilings do not provide protection against a falling worker striking a lower level: if a worker in the attic falls, he or she can plunge through the ceiling wall board to the floor below. When used in an interior space, or otherwise as may be desired, the anchors can be utilized in the inverted position as an overhead anchorage device.

The anchors herein can have an additional mechanical fastener that extends to or through the base plate to the underlying support structure (e.g., the chord) as a further precaution against movement in the event that a fall occurs prior to sheathing being installed over it. For example, the fastening can be achieved by two offset holes in the base plate that allow a suitable fastener such as a 16d nail or equal screw.

In some embodiments, the devices herein are created of a unitary piece of steel (or other suitable material) and can be installed using a single bolt (or other suitable fastening mechanism). This can eliminate the need to drill through the top chord/support structure because the anchor envelops the top chord instead of being "plugged" into it. Further, the wrap-around design encapsulates the top cord, which provides excellent strength to withstand free-fall forces (e.g., 1800-2500 lbs.).

In some embodiments, the anchors herein retain the top chord/support structure encapsulation feature with a truncated triangle design. The anchors can also be configured to be installed as a permanent anchor, for example permanently attached to a roofs flashing system or other suitable location.

Thus, in various aspects the anchors herein can include:

1) A single fastener (e.g., bolt) installed from the top side to hold the at least two legs of the anchor to each other.

2) No mechanical fastening or drilling of anchor to the top chord/underlying support structure, and no mechanical fastening or drilling of the top chord/underlying support structure.
3) Both legs of the anchor can be bent or formed at angles to create an opening (e.g., 1.0") that is at least partially less than the width of the top chord/underlying support structure (e.g., 1.5") to produce a compression effect that holds the anchor in place until the attachment bolt can be secured.
4) The legs can comprise a shorter leg and a longer leg. The first elongate leg can be configured with two angle bends:
   a) The first angle in the base plate/first elongate leg allows the anchor to be slid onto the top chord from the bottom plane (edge) of the top chord and reduces the amount the leg needs to be bent to intersect/contact the second elongate leg for attachment bolt to be used (the attachment bolt joins the two legs together); this reduces metal fatigue potential. Once fitted onto the top chord, the intra-connection portions of the first and/or second elongate legs is/are folded/bent to intersect the corresponding intra-connection portion of the other leg, for example requiring 1.0" movement toward the other leg.
   b) There can be a second angle in one or both legs to facilitate attachment to the other leg. For example, the intra-connection portion (e.g., a bolt hole flange) can be bent at a 45° angle. This can also facilitate removal by hammering down the extended portion of the leg (s), even through the finished roof or other covering structure. The angle can also reduce friction to a minimum allowing the anchor to be easily hammered down from the anchor stem top. An evacuation hole can be cut into the roof sheathing as desired to facilitate ultimate removal.

The removable or permanent anchors herein can be manufactured at a lower unit cost than the traditional series anchors presently used as permanent anchors, even though the anchors herein can attach to the same types of support structures and locations on such support structures as the traditional anchors. The new anchors can also be used with support structures/locations beyond those of the traditional anchors.

DETAILED DESCRIPTION

Figure 1:
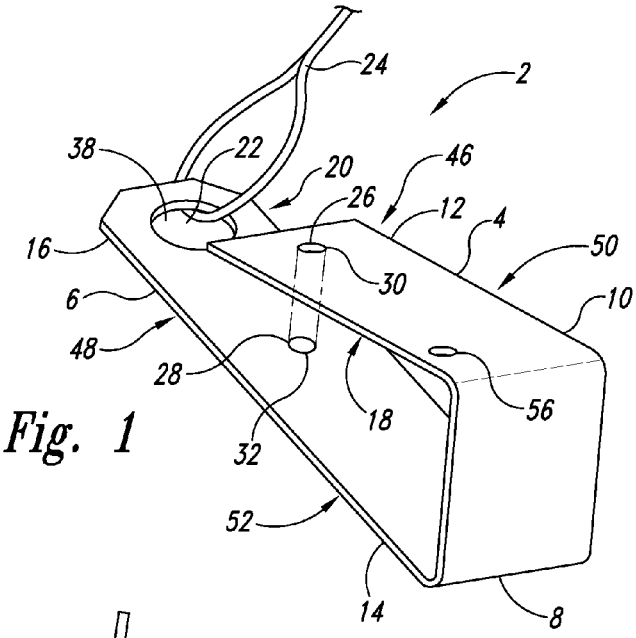
FIG. 1 depicts a perspective view of one embodiment of an anchor as discussed herein.
Figure 2:
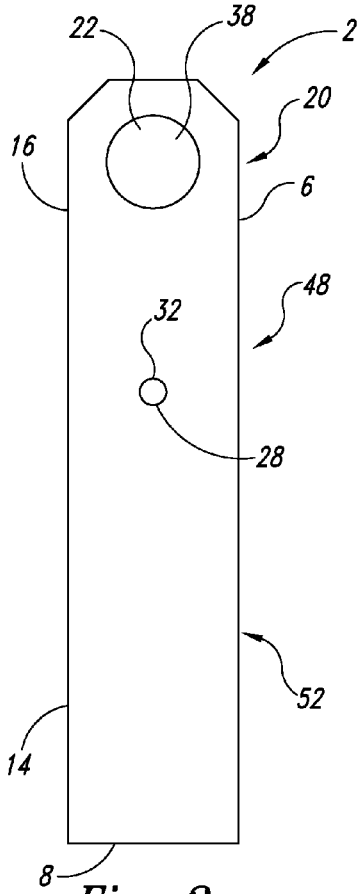
FIG. 2 depicts a rear plan view of the embodiment shown in FIG. 1.
Figure 3:
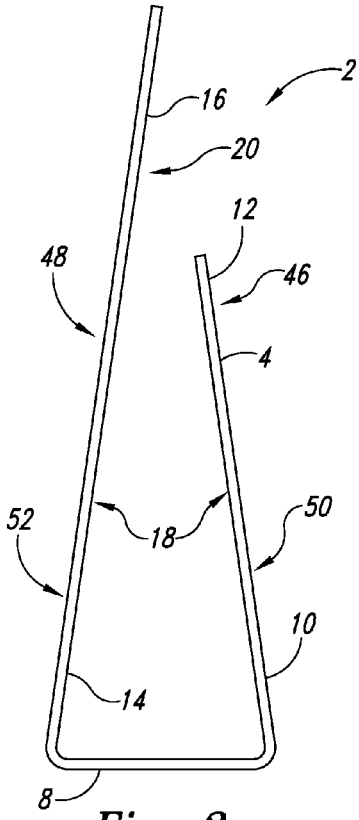
FIG. 3 depicts a side plan view of the embodiment shown in FIG. 1.
Figure 4:
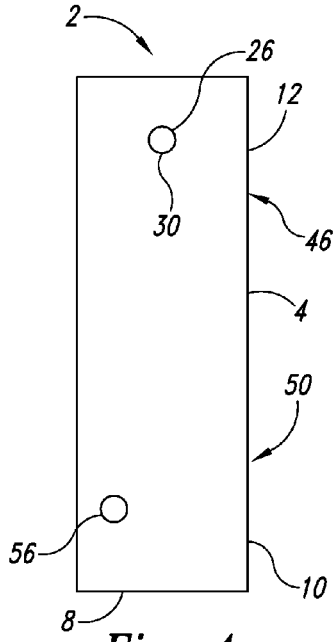
FIG. 4 depicts a front plan view of the embodiment shown in FIG. 1.

Turning to the figures, FIGS. 1-4 depict a U-shaped (e.g., triangular or truncated triangular) fall protection anchor 2 as discussed herein. The anchor 2 comprises a first elongate leg 4 and a second elongate leg 6 connected to each other at their respective base ends 10, 14. In the embodiment shown, the base ends 10, 14 are connected by a base plate 8 but any suitable connection configuration can be used. The first elongate leg 4 comprises a first base end 10 and a first apex end 12 and further comprises a first capture portion 50 near the first base end 10 and a first intra-connection portion 46 near the first apex end 12. At least the second elongate leg 6 comprises a second base end 14 and a second apex end 16 and further comprises a second capture portion 52 near the second base end 14 and a second intra-connection portion 48 near the second apex end 16 and a holding portion 20 located beyond the capture portion, the holding portion 20 comprises a holding element 22 such as holding hole 38 configured to securely hold a fall restraint device 24 connected to a worker.

Figure 9A:
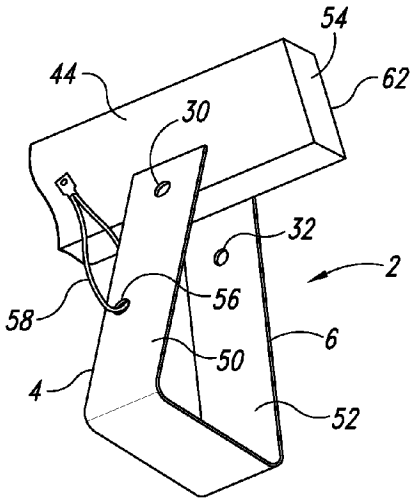
FIG. 9 depicts a perspective view of an embodiment of an anchor as discussed herein being placed onto a retention element, namely a top chord.
Figure 9B:
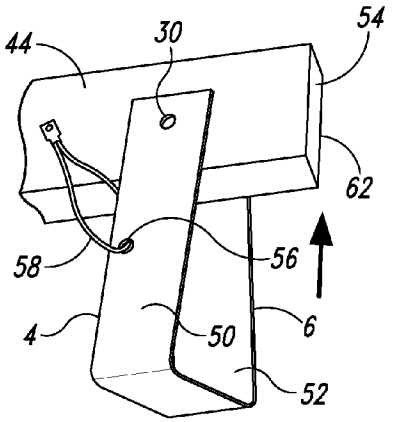
Figure 9C:
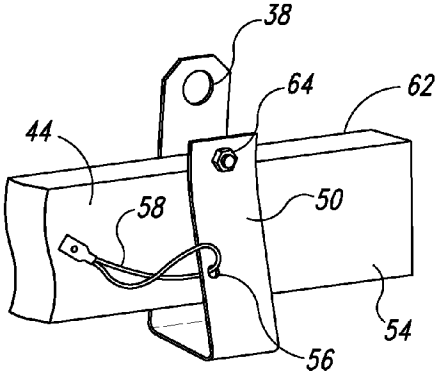
Figure 10:
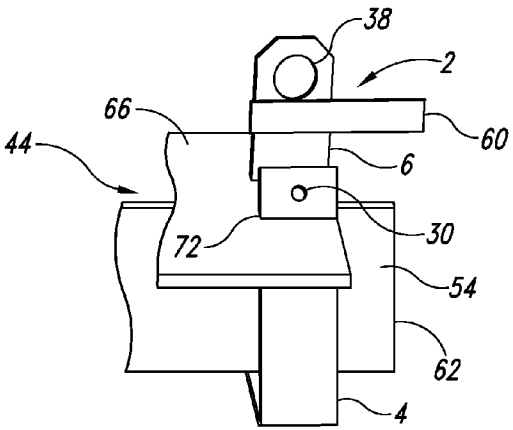
FIG. 10 depicts a perspective view of an embodiment of an anchor as discussed herein in place on a retention element and with a sheathing at the distal (apex) end of the anchor.
Figure 11:
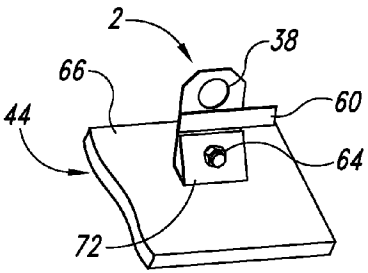
FIG. 11 depicts a perspective view of an embodiment of an anchor as discussed herein in place on a retention element and with a sheathing at the distal (apex) end of the anchor.

The first and second capture portions are configured to capture a retention element 54 such as a chord 62 (as shown in FIGS. 9-11) to hold the anchor 2 to a structure 44 (as shown in FIGS. 9-11), and the first and second intra-connection portions are configured to connect the legs to the other. The anchor 2 can be made from any suitable material such as zinc coated steel or stainless steel (SST).

As also shown in FIGS. 1-4, in some embodiments the first elongate leg 4 and the second elongate leg 6 incline 18 toward each other along their length as they extend from the base plate 4. The anchor 2 can also comprise a tether attachment element 56 and a tether 58 (an exemplary tether 58 is shown in FIGS. 9-11). The anchor 2 can be configured to be temporarily adhered or permanently adhered to the retention element 54.

The holding element 22 can be a hole in the holding portion 20 sized to receive the fall restraint device 24. The first and second intra-connection portions comprise corresponding holes configured to accept a securing device connecting the portions to each other. The anchor 2 can be a unitary piece of material or multiple pieces of material.

Turning to FIGS. 5-8, in some embodiments at least one of the first elongate leg 4 and the elongate second elongate leg 6 comprises an angle 68 distal to the respective capture portion that angles toward the other leg such that the distal portion can be maintained near the other leg without the inter-connection element and the angled leg forms an S-shape.

Figure 5:
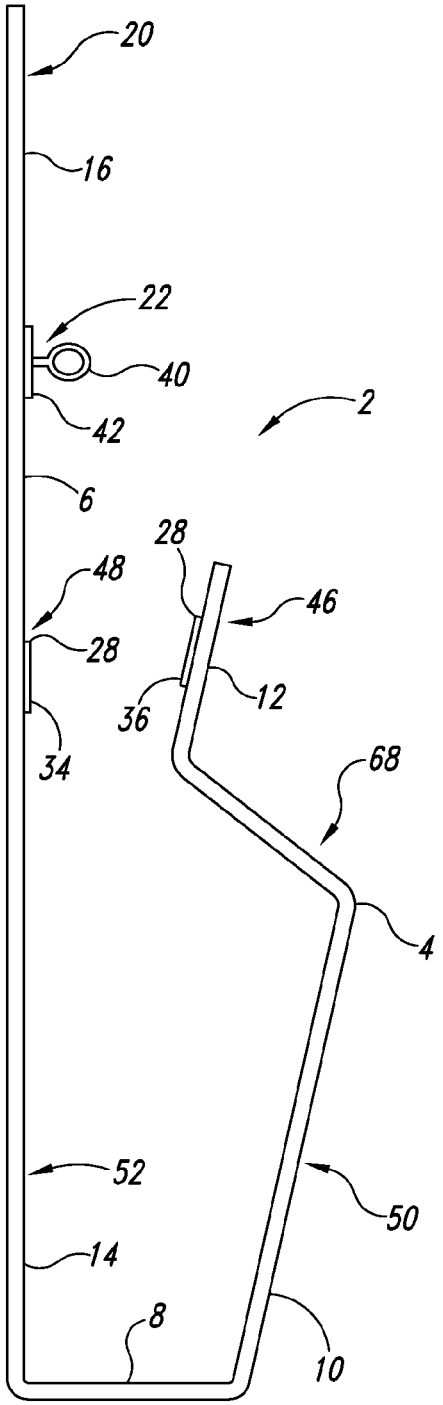
FIG. 5 depicts a side plan view of a further embodiment of an anchor as discussed herein.
Figure 6:
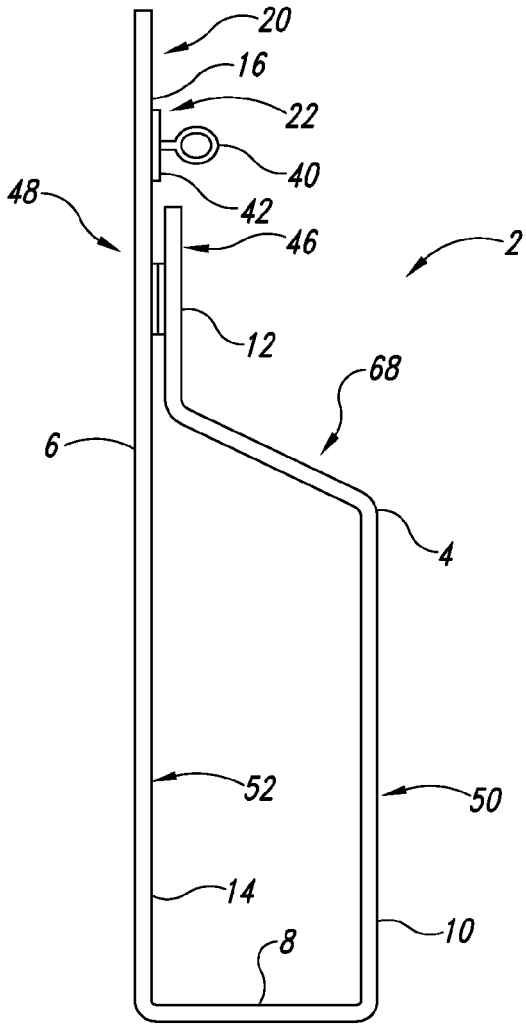
FIG. 6 depicts a side plan view of the embodiment shown in FIG. 5.
Figure 7:
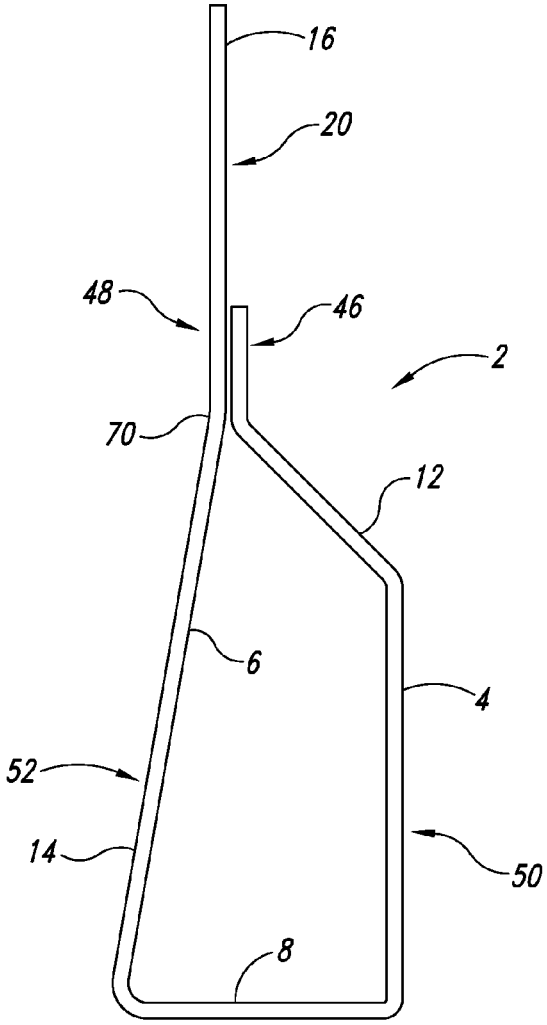
FIG. 7 depicts a side plan view of another embodiment of an anchor as discussed herein.
Figure 8:
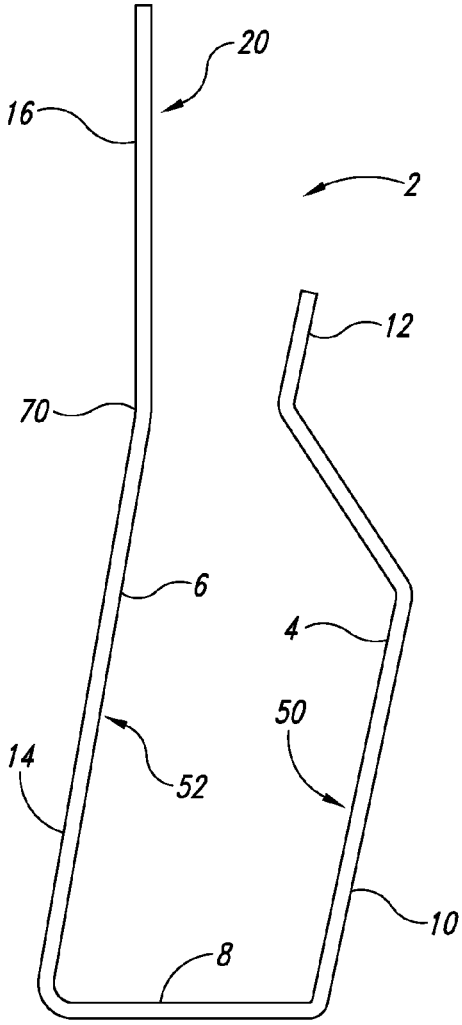
FIG. 8 depicts a side plan view of the embodiment shown in FIG. 5.

The first elongate leg 4 and the second elongate leg 6 can be parallel to each other as they extend from the base plate 4 as in FIGS. 5-6, or if desired can tilt relative to base plate 8 as in FIGS. 7-8.

In FIGS. 5-6, the first elongate leg 4 comprises a first intra-connection male element 34 while the second elongate leg 6 comprises a second intra-connection female element 36. As shown in FIG. 6, the two connect together to compress the two legs to each other. In the embodiment in FIGS. 5-6, the holding element 22 is a holding eye bolt 40 held to second elongate leg 6 by a holding eye bolt base 42.

In FIGS. 7-8, the second elongate leg 6 comprises a bend 70 distal to the second capture portion 52. The bend 70 can be pre-configured in the anchor 2, or it can comprise a tell-tale feature configured to indicate that the anchor 2 has been subjected to a fall-restraint-level force load and should not be used again. For example, as in FIG. 8, the tell-tale feature comprises the holding portion 20 being configured to significantly bend 70 upon being subject to the fall-restraint-level force load.

FIGS. 9-11 show both exemplary implementations of the anchor on a structure 44 such as top chord 62 and exemplary systems comprising multiple separate elements. In FIG. 9, a U-shaped fall protection anchor 2 as described herein is combined with a tether 58 configured to hold the anchor 2 to the structure 44 when the structure 44 is not captured within the first and second capture portions. The anchor 2 can also comprise a label 60 which can include usage instructions, safety instructions or other information as desired. The three panels of FIG. 9 show an anchor 2 being held beneath a chord 62 then slipped onto the chord 62, in the embodiment shown need no more than hand force (any suitable application system can be used), then the two legs 4, 6 of the anchor 2 are bolted to each other by bolt 64. This traps and captures the chord 62 between the first and second capture portions 50, 52.

The system can also comprise a leg-to-leg compression device 74 such as a bolt 64 sized to fit through corresponding intra-connection elements 26, 28 such as holes 30, 32 of each of first and second elongate legs 4, 6 and to compress the legs together.

The system can further comprise the structure 44 to which the anchor 2 can be held, the fall restraint device 24 to which the anchor 2 can be held, and/or a sheathing 66 comprising at least one opening 72 sized to receive the first and second elongated legs of the anchor 2.

In other aspects, the discussion herein also includes methods relating to the anchors herein including both methods of making and using such anchors. For example, methods of making an anchor 2 can comprise: a) providing at least one piece of material; and b) forming the material into the shape of the anchor.

For example as shown in FIGS. 9-11, methods of using an anchor 2 can comprise a) providing the anchor 2 according to claim 1, and b) attaching the anchor 2 to the structure 44 by enclosing the structure 44 within the first and second capture portions of the anchor 2.

The attaching the anchor 2 to the structure 44 can be effected solely by compressing the first and second intra-connection portions to each other and thereby enclosing the structure 44 between the first and second capture portions. The methods can also include one or more of tethering the anchor 2 to the structure 44; removing the anchor 2 from the structure 44; and/or subjecting the anchor 2 to a fall-restraint-level force load.

The removing can be effected solely by decompressing the first and second intra-connection portions from each other and thereby allowing removal of the structure 44 from between the first and second capture portions. The removing can include further steps if desired such as removing fastening devices such as screws that can be used to directly adhere the anchor 2 to the structure 44. The methods can further comprise activating the tell-tale feature, such as by bending the holding portion 20 of the second elongate leg 6 of the anchor 2 due to application of force of a fall-restraint-level force load.

All terms used herein are used in accordance with their ordinary meanings unless the context or definition clearly indicates otherwise. Also unless expressly indicated otherwise, in the specification the use of "or" includes "and" and vice-versa. Non-limiting terms are not to be construed as limiting unless expressly stated, or the context clearly indicates, otherwise (for example, "including," "having," and "comprising" typically indicate "including without limitation"). Singular forms, including in the claims, such as "a," "an," and "the" include the plural reference unless expressly stated, or the context clearly indicates, otherwise.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods, etc., include such modifications as well as all permutations and combinations of the subject matter set forth herein and are not limited except as by the appended claims or other claim having adequate support in the discussion and figures herein.

What is claimed is:

1. A fall protection system comprising a) a U-shaped fall protection anchor comprising:

a first elongate leg and a second elongate leg connected to each other at a base, wherein, the first elongate leg comprises a first base end and a first apex end and further comprising a first capture portion near the first base end and a first intra-connection portion near the first apex end;

the second elongate leg comprises a second base end and a second apex end and further comprising a second capture portion near the second base end and a second intra-connection portion near the second apex end and a holding portion located distal to the second capture portion, the holding portion comprising a holding element configured to securely hold a fall restraint device connected to a worker, and wherein the first and second capture portions are configured to capture a retention element to hold the anchor to a structure, and the first and second intra-connection portions are configured to connect each leg to the other leg; and b) a tether configured to hold the anchor to the structure when the structure is not captured by the first and second capture portions, wherein the first elongate leg and the second elongate leg are connected to each other at the base, plate, wherein the first leg and the second leg incline towards each other as they extend from the base, wherein the legs and the base are collectively made of a single piece of material, wherein the holding portion is configured to significantly bend to indicate that the anchor has been subjected to a fall-restraint-level force load and should not be used again, and wherein the first and second intra-connection portions comprise corresponding holes configured to accept a securing device connecting the first and second intra-connection portions to each other plate.

2. The system of claim 1 wherein the anchor is made from zinc coated steel or stainless steel (SST).

3. The system of claim 1 wherein the anchor further comprises a tether attachment element.

4. The system of claim 1 wherein the anchor is configured to be temporarily adhered to the retention element.

5. The system of claim 1 wherein the anchor is configured to be permanently adhered to the retention element.

6. The system of claim 1 wherein the holding element is a hole in the holding portion sized to receive the fall restraint device.

7. The system of claim 1 further comprising the structure to which the anchor is held.

8. The system of claim 1 further comprising the fall restraint device to which the anchor is held.

9. The system of claim 1 further comprising a leg-to-leg compression device configured to compress together the first and second elongated legs of the anchor.

10. The system of claim 9 wherein the leg-to-leg compression device is a bolt sized to fit through the corresponding holes of the first and second intra-connection portions of each of the first and second elongate legs.

11. A method of making the fall protection system of claim 1 comprising:

a) providing the fall protection system and at least one piece of material, and b) forming the at least one piece of material into the U-shaped fall protection anchor.

12. The fall protection system of claim 1, the method comprising:

a) providing the fall protection system, and b) attaching the U-shaped fall protection anchor to the retention element by enclosing the retention element within the first and second capture portions of the U-shaped fall protection anchor a U-shaped fall protection anchor comprising: a first elongate leg and a second elongate leg connected to each other at a base, wherein, the first elongate leg comprises a first base end and a first apex end and further comprising a first capture portion near the first base end and a first intra-connection portion near the first apex end; the second elongate leg comprises a second base end and a second apex end and further comprising a second capture portion near the second base end and a second intra-connection portion near the second apex end and a holding portion located distal to the second capture portion, the holding portion comprising a holding element configured to securely hold a fall restraint device connected to a worker, and wherein the first and second capture portions are configured to capture a retention element of a structure, and the first and second intra-connection portions are configured to connect each leg to the other leg, the method comprising:

a) providing the U-shaped fall protection anchor, and b) attaching the anchor to a retention element by enclosing the retention element within the first and second capture portions of the anchor.

13. The method of claim 12 wherein the attaching the anchor to the retention element is effected solely by compressing the first and second intra-connection portions to each other and thereby enclosing the retention element between the first and second capture portions.

14. The method of claim 12 further comprising tethering the anchor to a structure comprising the retention element.

15. The method of claim 12 further comprising removing the anchor from the retention element.

16. The method of claim 15 wherein the removing is effected by decompressing the first and second intra-connection portions from each other and thereby allowing removal of the retention element from between the first and second capture portions.

17. The method of claim 12 further comprising subjecting the anchor to a fall-restraint-level force load.

18. The method of claim 17 further comprising bending the holding portion of the second elongate leg of the anchor due to force of the fall-restraint-level force load to provide a tell-tale feature indicating effects of the fall-restraint-level force load.

* * * * *